US010436505B2

(12) United States Patent
Jiang et al.

(10) Patent No.: US 10,436,505 B2
(45) Date of Patent: Oct. 8, 2019

(54) LNG RECOVERY FROM SYNGAS USING A MIXED REFRIGERANT

(71) Applicant: Black & Veatch Corporation, Overland Park, KS (US)

(72) Inventors: Hao Jiang, Beijing (CN); Shawn D. Hoffart, Overland Park, KS (US)

(73) Assignee: BLACK & VEATCH HOLDING COMPANY, Overland Park, KS (US)

( * ) Notice: Subject to any disclaimer, the term of this patent is extended or adjusted under 35 U.S.C. 154(b) by 658 days.

(21) Appl. No.: 14/182,115

(22) Filed: Feb. 17, 2014

(65) Prior Publication Data

US 2015/0233633 A1 Aug. 20, 2015

(51) Int. Cl.
*F25J 1/00* (2006.01)
*F25J 3/02* (2006.01)

(52) U.S. Cl.
CPC ..... *F25J 3/0223* (2013.01); *F25J 3/0233* (2013.01); *F25J 3/0271* (2013.01); *F25J 2200/04* (2013.01); *F25J 2200/74* (2013.01); *F25J 2200/78* (2013.01); *F25J 2205/04* (2013.01); *F25J 2215/04* (2013.01); *F25J 2230/08* (2013.01); *F25J 2230/32* (2013.01); *F25J 2240/02* (2013.01); *F25J 2270/18* (2013.01); *F25J 2270/66* (2013.01); *F25J 2270/902* (2013.01); *F25J 2290/34* (2013.01)

(58) Field of Classification Search
CPC ..... F25J 3/0209; F25J 3/0223; F25J 3/0271; F25J 2210/60
See application file for complete search history.

(56) References Cited

U.S. PATENT DOCUMENTS

| | | | | |
|---|---|---|---|---|
| 3,596,472 A | | 8/1971 | Streich | |
| 3,763,658 A | | 10/1973 | Gaumer, Jr. et al. | |
| 4,033,735 A | | 7/1977 | Swenson | |
| 4,675,036 A | * | 6/1987 | Bauer | C07C 7/005 62/622 |
| 5,133,793 A | * | 7/1992 | Billy | F25J 3/0223 62/630 |
| 5,505,049 A | | 4/1996 | Coyle et al. | |
| 5,657,643 A | | 8/1997 | Price | |
| 5,669,234 A | | 9/1997 | Houser et al. | |
| 6,016,665 A | | 1/2000 | Cole et al. | |

(Continued)

FOREIGN PATENT DOCUMENTS

| | | |
|---|---|---|
| CN | 1946979 | 4/2007 |
| CN | 102115684 | 7/2011 |

(Continued)

OTHER PUBLICATIONS

English translation of Schmidt (DE102012004047A1), provided by Espacenet. Feb. 2018.*

(Continued)

*Primary Examiner* — Tareq Alosh
(74) *Attorney, Agent, or Firm* — Hovey Williams LLP

(57) ABSTRACT

Processes and systems are provided for recovering a liquid natural gas (LNG) stream from a hydrocarbon-containing feed gas stream using a single closed-loop mixed refrigerant cycle. In particular, the processes and systems described herein can be used to separate methane from carbon monoxide and hydrogen, which are common components in synthesis gas and other hydrocarbon-containing gases.

22 Claims, 1 Drawing Sheet

(56) References Cited

U.S. PATENT DOCUMENTS

| | | | | |
|---|---|---|---|---|
| 6,119,479 | A | 9/2000 | Roberts et al. | |
| 6,289,692 | B1 | 9/2001 | Houser et al. | |
| 6,308,531 | B1 | 10/2001 | Roberts et al. | |
| 8,328,995 | B2 | 12/2012 | Eddington | |
| 2009/0205367 | A1* | 8/2009 | Price | F25J 3/0223 62/612 |
| 2009/0277217 | A1 | 11/2009 | Ransbarger et al. | |
| 2011/0048067 | A1* | 3/2011 | Fischer | F25J 1/0022 62/620 |
| 2011/0226008 | A1* | 9/2011 | Gushanas | F25J 1/0012 62/613 |
| 2011/0239701 | A1 | 10/2011 | Kaart et al. | |
| 2011/0289963 | A1 | 12/2011 | Price | |
| 2012/0137726 | A1 | 6/2012 | Currence et al. | |
| 2012/0285196 | A1 | 11/2012 | Flinn et al. | |
| 2013/0205828 | A1 | 8/2013 | Sethna et al. | |
| 2013/0213087 | A1* | 8/2013 | Currence | F25J 3/0209 62/621 |

FOREIGN PATENT DOCUMENTS

| | | | | |
|---|---|---|---|---|
| CN | 102435044 | | 5/2012 | |
| DE | 102012004047 | A1 * | 9/2013 | F25J 3/0223 |
| WO | WO 2013/055305 | A1 * | 4/2013 | |

OTHER PUBLICATIONS

Office Action in China received in CN 20150084076.1.
PCT International Search Report and Written Opinion from PCT Application No. PCT/US2015/037126 (dated Aug. 24, 2015).

* cited by examiner

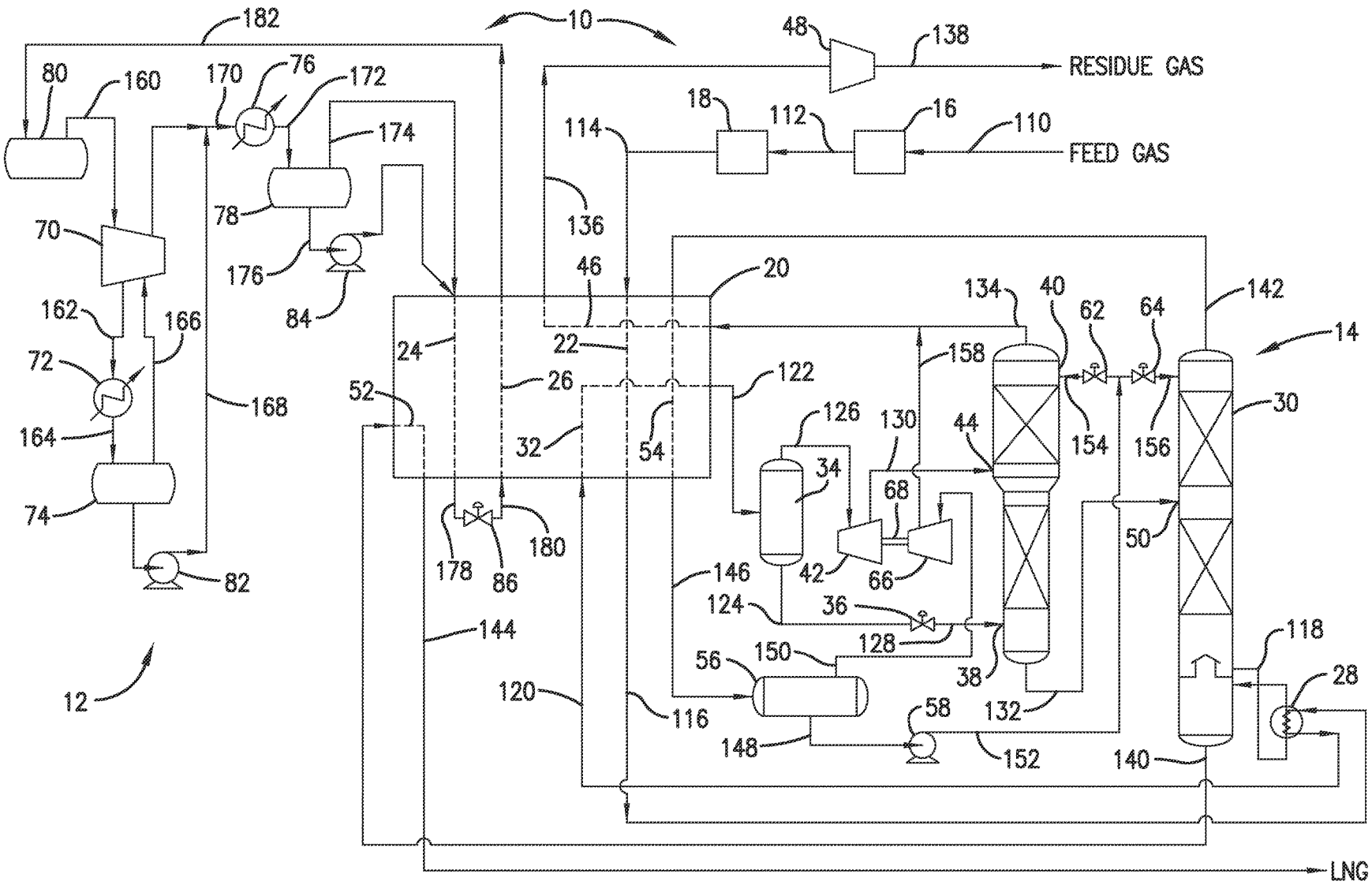
RESIDUE GAS
FEED GAS
LNG

LNG RECOVERY FROM SYNGAS USING A MIXED REFRIGERANT

BACKGROUND

1. Field of the Invention

The present invention is generally related to processes and systems for recovering a liquid natural gas ("LNG") from a hydrocarbon-containing gas. More particularly, the present invention is generally related to processes and systems for recovering a LNG from a synthesis gas using a single closed-loop mixed refrigerant cycle.

2. Description of the Related Art

Synthesis gas, which is also known as "syngas," is a common byproduct formed during steam reforming of natural gas or hydrocarbons, coal gasification, and waste-to-energy gasification. Syngas generally contains varying amounts of carbon monoxide and hydrogen and, in some circumstances, can also contain notable amounts of methane. Due to the commercial value of methane, it can be desirable in some cases to remove at least a portion of the methane from syngas. However, the presence of carbon monoxide and hydrogen in these gases can greatly reduce the efficiencies of conventional recovery processes since these processes are generally unable to fully condense and separate the carbon monoxide and hydrogen from the methane at the recovery temperatures commonly used during these various processes. Thus, the recovered methane can be contaminated with high levels of residual carbon monoxide and/or hydrogen. Consequently, the presence of carbon monoxide and hydrogen in syngas and other hydrocarbon-containing gases can negatively impact the recovery of methane from these gases.

Therefore, there is a need for processes and systems that can effectively recover methane from syngas and other hydrocarbon-containing gases despite the presence of carbon monoxide and hydrogen in these gases.

SUMMARY

One or more embodiments described herein concern a process for recovering liquid methane gas from a hydrocarbon-containing gas. The method comprises: (a) cooling and at least partially condensing the hydrocarbon-containing gas to thereby provide a cooled feed stream; (b) separating at least a portion of the cooled feed stream in a primary distillation column to thereby form a first methane-rich bottom stream and a first methane-poor overhead stream; (c) fractionating at least a portion of the first methane-rich bottom stream in a secondary distillation column to thereby form a second methane-rich bottom stream and a second methane-poor overhead stream; and (d) recovering at least a portion of the second methane-rich stream to thereby produce an LNG-enriched stream.

One or more embodiments described herein concern a process for recovering liquid methane gas from a hydrocarbon-containing gas. The process comprises: (a) cooling and at least partially condensing the hydrocarbon-containing gas to thereby provide a cooled feed stream; (b) separating at least a portion of the cooled feed stream in a primary distillation column to thereby form a first methane-rich liquid stream and a first methane-poor vapor stream; (c) fractionating at least a portion of the first methane-rich liquid stream in a secondary distillation column to thereby form a second methane-rich liquid stream and a second methane-poor vapor stream; and (d) cooling at least a portion of the second methane-rich liquid stream to thereby produce an LNG-enriched liquid stream.

One or more embodiments described herein concern a facility for recovering liquid methane gas from a hydrocarbon-containing gas. The facility comprises: a primary heat exchanger having a first cooling pass disposed therein, wherein the first cooling pass is configured to cool the hydrocarbon-containing gas into a cooled hydrocarbon-containing gas; a vapor-liquid separator in fluid communication with the first cooling pass, wherein the vapor-liquid separator is configured to separate the cooled hydrocarbon-containing gas into a first methane-poor overhead stream and a first methane-rich bottom stream; a primary distillation column in fluid communication with the vapor-liquid separator, wherein the primary distillation column comprises a first liquid inlet to receive the first methane-rich bottom stream and a first vapor inlet to receive the first methane-poor overhead stream, wherein the primary distillation column is configured to separate the first methane-rich bottom stream and the first methane-poor overhead stream into a second methane-rich bottom stream and a second methane-poor overhead stream; a secondary distillation column in fluid communication with the primary distillation column, wherein the secondary distillation column comprises a second liquid inlet to receive the second methane-rich bottom stream and a second vapor inlet to receive the second methane-poor overhead stream, wherein the secondary distillation column is configured to separate the second methane-rich bottom stream and the second methane-poor overhead stream into a third methane-rich bottom stream and a third methane-poor overhead stream; a second cooling pass disposed within the primary heat exchanger in fluid communication with the secondary distillation column, wherein the second cooling pass is configured to cool the third-methane rich bottom stream into an LNG-enriched liquid stream; and a single closed-loop mixed refrigeration cycle at least partially disposed within the primary heat exchanger. The single closed-loop refrigeration cycle comprises a refrigerant compressor defining a suction inlet for receiving a mixed refrigerant stream and a discharge outlet for discharging a stream of compressed mixed refrigerant; a first refrigerant cooling pass in fluid communication with the discharge outlet of the refrigerant compressor, wherein the first refrigerant cooling pass is configured to cool the compressed mixed refrigerant stream; a refrigerant expansion device in fluid communication with the first refrigerant cooling pass, wherein the refrigerant expansion device is configured to expand the cooled mixed refrigerant stream and generate refrigeration; and a first refrigerant warming pass in fluid communication with the refrigerant expansion device and the suction inlet of the refrigerant compressor, wherein the first refrigerant warming pass is configured to warm the expanded mixed refrigerant stream via indirect heat exchange.

BRIEF DESCRIPTION OF THE FIGURES

Embodiments of the present invention are described herein with reference to the following drawing FIGURES, wherein:

FIG. 1 provides a schematic depiction of an LNG recovery facility configured according to one embodiment of the present invention, particularly illustrating the use of a single closed-loop mixed refrigerant system to recover methane from a feed gas stream.

DETAILED DESCRIPTION

The following detailed description of embodiments of the invention references the accompanying drawing. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

The present invention is generally directed to processes and systems for the separation of a hydrocarbon-containing gas into an LNG stream and a byproduct stream comprising hydrogen and carbon monoxide. As described below, the processes and systems can utilize a refrigerant system to recover at least a portion of the methane from the hydrocarbon-containing gases. Although FIG. 1 depicts this refrigerant system comprising a single closed-loop mixed refrigeration cycle, one skilled in the art would appreciate that another refrigeration system can be used in the process and system described below. For example, the refrigeration system can comprise a single mixed refrigerant stream in a closed-loop refrigeration cycle, a dual mixed refrigerant cycle, or a cascade refrigeration cycle. Such refrigeration systems are described in U.S. Pat. Nos. 3,763,658, 5,669,234, 6,016,665, 6,119,479, 6,289,692, and 6,308,531, the disclosures of which are incorporated herein by reference in their entireties. Furthermore, in various embodiments, the processes and systems described herein do not utilize a nitrogen refrigerant loop that is separate from the disclosed refrigerant systems due to the configurations described further below.

Turning now to FIG. 1, a schematic depiction of a LNG recovery facility 10 configured according to one or more embodiments of the present invention is provided. The LNG recovery facility 10 can be operable to remove or recover a substantial portion of the total amount of methane in the incoming hydrocarbon-containing gas stream by cooling the gas with a single closed-loop refrigeration cycle 12 and separating the resulting condensed liquids in a LNG separation zone 14. Additional details regarding the configuration and operation of LNG recovery facility 10, according to various embodiments of the present invention, are described below in reference to FIG. 1.

As shown in FIG. 1, a hydrocarbon-containing gas feed stream can initially be introduced into the LNG recovery facility 10 via conduit 110. The hydrocarbon-containing gas can be any suitable hydrocarbon-containing fluid stream, such as, for example, a natural gas stream, a syngas stream, a cracked gas stream, or combinations thereof. The hydrocarbon-containing gas stream in conduit 110 can originate from a variety of gas sources (not shown), including, but not limited to, a petroleum production well; a refinery processing unit, such as a fluidized catalytic cracker (FCC) or petroleum coker; or a heavy oil processing unit, such as an oil sands upgrader. In certain embodiments, the hydrocarbon-containing gas in conduit 110 can comprise or consist of a syngas.

Depending on its source, the hydrocarbon-containing gas can comprise varying amounts of methane, hydrogen, and carbon monoxide. For example, the hydrocarbon-containing gas can comprise at least about 1, 5, 10, 15, or 25 and/or not more than about 80, 70, 60, 50, or 40 mole percent of methane. More particularly, the hydrocarbon-containing gas can comprise in the range of about 1 to 80, 5 to 70, 10 to 60, 15 to 50, 15 to 50, or 25 to 40 mole percent of methane. It should be noted that all mole percentages are based on the total moles of the hydrocarbon-containing gas.

Additionally or alternatively, the hydrocarbon-containing gas can comprise at least about 15, 25, or 40 and/or not more than about 95, 90, or 80 mole percent of carbon monoxide. More particularly, the hydrocarbon-containing gas can comprise in the range of about 15 to 95, 25 to 90, or 40 to 80 mole percent of carbon monoxide. Furthermore, in certain embodiments, hydrocarbon-containing gas can comprise at least about 25, 40, or 50 and/or not more than about 99, 90, or 75 mole percent of hydrogen. More particularly, the hydrocarbon-containing gas can comprise in the range of about 25 to 99, 40 to 90, or 50 to 70 mole percent of hydrogen.

As one skilled in the art would appreciate, the hydrogen and carbon monoxide contents of the hydrocarbon-containing gas can vary depending on its source. Thus, in various embodiments, the hydrocarbon-containing gas can comprise a molar ratio of hydrogen to carbon monoxide of at least 1:1, 1.5:1, or 2:1 and/or not more than 10:1, 5:1, or 2.5:1. More particularly, the hydrocarbon-containing gas can comprise a molar ratio of hydrogen to carbon monoxide in the range of 1:1 to 10:1, 1.5:1 to 5:1, or 2:1 to 2.5:1.

Furthermore, the hydrocarbon-containing gas can comprise some amount of $C_2$-$C_5$ components, which includes paraffinic and olefinic isomers thereof. For example, the hydrocarbon-containing gas can comprise less than 15, 10, 5, or 2 mole percent of $C_2$-$C_5$ components.

As shown in FIG. 1, the hydrocarbon-containing gas in conduit 110 may initially be routed to a pretreatment zone 16, wherein one or more undesirable constituents may be removed from the gas prior to cooling. In one or more embodiments, the pretreatment zone 16 can include one or more vapor-liquid separation vessels (not shown) for removing liquid water or hydrocarbon components from the feed gas. Optionally, the pretreatment zone 16 can include one or more acid gas removal zones (not shown), such as, for example, an amine unit, for removing carbon dioxide or sulfur-containing compounds from the gas stream in conduit 110.

The treated gas stream exiting pretreatment zone 16 via conduit 112 can then be routed to a dehydration unit 18, wherein substantially all of the residual water can be removed from the feed gas stream. Dehydration unit 18 can utilize any known water removal system, such as, for example, beds of molecular sieve. Once dried, the gas stream in conduit 114 can have a temperature of at least 5, 10, or 15° C. and/or not more than 100, 75, or 40° C. More particularly, the gas stream in conduit 114 can have a temperature in the range of 5 to 100° C., 10 to 75° C., or 15 to 40° C. Additionally or alternatively, the gas stream in conduit 114 can have a pressure of at least 1.5, 2.5, 3.5, or 4.5 and/or 9, 8, 7, or 6 MPa. More particularly, the gas stream in conduit 114 can have a pressure in the range of 1.5 to 9, 2.5 to 8, 3.5 to 7, or 4.5 to 6 MPa.

As shown in FIG. 1, the hydrocarbon-containing feed stream in conduit 114 can be introduced into a first cooling pass 22 of a primary heat exchanger 20. The primary heat exchanger 22 can be any heat exchanger or series of heat exchangers operable to cool and at least partially condense the feed gas stream in conduit 114 via indirect heat exchange with one or more cooling streams. In one or more embodiments, the primary heat exchanger 20 can be a brazed aluminum heat exchanger comprising a plurality of cooling and warming passes (e.g., cores) disposed therein for facilitating indirect heat exchange between one or more process streams and one or more refrigerant streams. Although generally illustrated in FIG. 1 as comprising a single core or "shell," it should be understood that primary heat exchanger 20 can, in some embodiments, comprise two or more separate core or shells, optionally encompassed by a "cold box" to minimize heat gain from the surrounding environment.

The hydrocarbon-containing feed gas stream passing through the cooling pass 22 of primary heat exchanger 20 can be cooled and at least partially condensed via indirect heat exchange with refrigerant and/or residue gas streams in respective passes 24 and 26, which are described below in further detail. During cooling, a substantial portion of the methane components in the feed gas stream can be condensed out of the vapor phase to thereby provide a cooled, two-phase gas stream in conduit 116. In one or more embodiments, at least 50, 60, 70, 80, or 90 mole percent of the total amount of methane introduced into primary exchanger 20 via conduit 114 can be condensed within cooling pass 22.

The cooled gas stream in conduit 116 can have a temperature of at least −30, −40, −50, or −60° C. and/or not more than about −130, −120, −110, or −100° C. More particularly, the cooled gas stream in conduit 116 can have a temperature in the range of about −30 to −130° C., −40 to −120° C., −50 to −110° C., or −60 to −100° C. In certain embodiments, the cooled gas stream in conduit 116 can have a temperature of about −66° C. Additionally or alternatively, the cooled gas stream in conduit 116 can have a pressure of at least 1.5, 2.5, 3.5, or 4.5 and/or 9, 8, 7, or 6 MPa. More particularly, the gas stream in conduit 114 can have a pressure in the range of 1.5 to 9, 2.5 to 8, 3.5 to 7, or 4.5 to 6 MPa.

As shown in FIG. 1, the cooled gas stream in conduit 116 can be transferred to at least one reboiler 28 to optionally function as heat media for the methane fractionator 30. As described below, the reboiler 28 can be used to heat and at least partially vaporize a liquid stream withdrawn from the methane fractionator 30 via conduit 118. The reboiler 28 can heat the liquid stream in conduit 118 via indirect heat exchange with a warming fluid stream, such as, for example, the cooled gas stream in conduit 116. Although generally illustrated as including a single reboiler 28, it should be understood that any suitable number of reboilers, operable to withdraw streams at the same or different mass transfer stages within distillation column 30, can be employed in order to maintain the desired temperature and/or composition profile therein.

While in the reboiler 28, the cooled gas stream from conduit 116 can be further cooled by the liquid stream from conduit 118. For example, while in the reboiler 28, the temperature of the cooled gas stream from conduit 116 can be lowered by at least 20, 30, 40, or 50° C. and/or not more than about 100, 80, 70, or 60° C. More particularly, while in the reboiler 28, the temperature of the cooled gas stream from conduit 116 can be lowered in the range of 20 to 100° C., 30 to 80° C., 40 to 70° C., or 50 to 60° C.

Upon exiting the reboiler 28, the cooled gas stream in conduit 120 can have a pressure of at least 1.5, 2.5, 3.5, or 4.5 and/or 9, 8, 7, or 6 MPa. More particularly, the gas stream in conduit 120 can have a pressure in the range of 1.5 to 9, 2.5 to 8, 3.5 to 7, or 4.5 to 6 MPa. It should be noted that the only pressure drop can be generally attributed to inefficiencies associated with the piping and heat exchanger.

Turning again to FIG. 1, at least a portion of the cooled gas stream in conduit 120 can be routed to a cooling pass 32 disposed within the primary heat exchanger 20, wherein the gas stream can be cooled and at least partially condensed via indirect heat exchange with the refrigerant and/or residue gas streams in respective passes 24 and 26, which are described below in further detail. During cooling, a substantial portion of the methane components in the cooled gas stream from conduit 120 can be condensed out of the vapor phase to thereby provide a further cooled, two-phase gas stream in conduit 122. In one or more embodiments, at least 50, 60, 70, 80, or 90 mole percent of the total amount of methane introduced into primary exchanger 20 via conduit 120 that is in vapor form can be condensed within cooling pass 32.

The cooled gas stream in conduit 122 can have a temperature of at least temperature of at least −120, −130, −140, or −−145° C. and/or not more than about −200, −190, −180, or −165° C. More particularly, the cooled gas stream in conduit 122 can have a temperature in the range of about −120 to −200° C., −130 to −190° C., −140 to −180° C., or −145 to −165° C. In certain embodiments, the cooled gas stream in conduit 122 can have a temperature of about −156° C. Additionally or alternatively, the cooled gas stream in conduit 122 can have a pressure of at least 1.5, 2.5, 3.5, or 4.5 and/or 9, 8, 7, or 6 MPa. More particularly, the gas stream in conduit 122 can have a pressure in the range of 1.5 to 9, 2.5 to 8, 3.5 to 7, or 4.5 to 6 MPa.

As shown in FIG. 1, the cooled, preferably two-phase stream in conduit 122 can be introduced into a separation vessel 34, wherein the vapor and liquid portions of the feed gas stream can be separated into an initial methane-rich bottom stream exiting via conduit 124 and an initial methane-poor overhead stream exiting via conduit 126. As used herein, "methane-poor" and "methane-rich" refer to the methane content of the separated components relative to the methane content of the original component from which the separated components are derived. Thus, a methane-rich component contains a greater mole percentage of methane than the component from which it is derived, while a methane-poor component contains a lesser mole percentage of methane than the component from which it is derived. In the present case, the initial methane-rich bottom stream contains a higher mole percentage of methane compared to the stream from conduit 122, while initial methane-poor overhead stream contains a lower mole percentage of methane compared to the stream from conduit 122. The amounts of the initial methane-rich bottom stream and the initial methane-poor overhead stream can vary depending on the contents of the hydrocarbon-containing gas and the operating conditions of the separation vessel 34.

The separation vessel 34 can be any suitable vapor-liquid separation vessel and can have any number of actual or theoretical separation stages. In one or more embodiments, separation vessel 34 can comprise a single separation stage, while in other embodiments, the separation vessel 34 can include 2 to 10, 4 to 20, or 6 to 30 actual or theoretical separation stages. When separation vessel 34 is a multistage separation vessel, any suitable type of column internals, such as mist eliminators, mesh pads, vapor-liquid contacting trays, random packing, and/or structured packing, can be used to facilitate heat and/or mass transfer between the vapor and liquid streams. In some embodiments, when separation vessel 34 is a single-stage separation vessel, few or no column internals can be employed.

In various embodiments, the separation vessel 34 can operate at a pressure of at least 1.5, 2.5, 3.5, or 4.5 and/or 9, 8, 7, or 6 MPa. More particularly, the separation vessel 34 can operate at a pressure in the range of 1.5 to 9, 2.5 to 8, 3.5 to 7, or 4.5 to 6 MPa. The initial methane-rich bottom stream in conduit 124 and/or the initial methane-poor overhead stream in conduit 126 can have a temperature of at least temperature of at least −120, −130, −140, or −145° C. and/or not more than about −200, −190, −180, or −165° C. More particularly, the initial methane-rich bottom stream in conduit 124 and/or the initial methane-poor overhead stream in conduit 126 can have a temperature in the range of about −120 to −200° C., −130 to −190° C., −140 to −180° C., or −145 to −165° C.

The initial methane-rich bottom stream in conduit 124 can be in the form of a liquid and can comprise a large portion of methane. For example, the initial methane-rich bottom stream in conduit 124 can comprise at least about 10, 25, 40, or 50 and/or not more than about 95, 85, 75, or 70 mole percent of methane. More particularly, the initial methane-rich bottom stream in conduit 124 can comprise in the range of about 10 to 95, 25 to 85, 40 to 75, or 50 to 70 mole percent of methane. Furthermore, the initial methane-rich bottom stream in conduit 124 can comprise at least 50, 60, 70, 80, or 90 percent of the methane originally present in the stream from conduit 122.

The initial methane-rich bottom stream in conduit 124 can also comprise residual amounts of hydrogen and carbon monoxide. For example, the initial methane-rich bottom stream in conduit 124 can comprise less than about 40, 30, 20, or 10 mole percent of hydrogen. Additionally or alternatively, the initial methane-rich bottom stream in conduit 124 can comprise less than about 60, 50, 45, or 40 mole percent of carbon monoxide.

The initial methane-poor overhead stream in conduit 126 can be in the form of a vapor and comprise a large portion of hydrogen and/or carbon monoxide. For example, the initial methane-poor overhead stream in conduit 126 can comprise at least about 10, 20, 35, or 50 and/or not more than about 95, 90, 85, or 70 mole percent of hydrogen. More particularly, the initial methane-poor overhead stream in conduit 126 can comprise in the range of 10 to 95, 20 to 90, 35 to 85, or 50 to 70 mole percent of hydrogen. Additionally or alternatively, the initial methane-poor overhead stream in conduit 126 can comprise at least about 5, 10, 15, or 20 and/or not more than about 80, 60, 50, or 40 mole percent of carbon monoxide. More particularly, the initial methane-poor overhead stream in conduit 126 can comprise in the range of about 5 to 80, 10 to 60, 15 to 50, or 20 to 40 mole percent of carbon monoxide. Furthermore, the initial methane-poor overhead stream in conduit 126 can contain minor amounts of methane. For example, the initial methane-poor overhead stream in conduit 126 can comprise less than about 20, 15, 10, or 5 mole percent of methane.

As depicted in FIG. 1, the initial methane-rich bottom stream in conduit 124 can pass through an expansion device 36, where the pressure of the liquid can be reduced to thereby flash or vaporize at least a portion thereof. Expansion device 36 can be any suitable expansion device, such as, for example, a Joule-Thompson valve or orifice or a hydraulic turbine. Although illustrated in FIG. 1 as comprising a single device 36, it should be understood that any suitable number of expansion devices can be employed. In certain embodiments, the expansion can be a substantially isenthalpic expansion. As used herein, the term "substantially isenthalpic" refers to an expansion or flashing step carried out such that less than 1 percent of the total work generated during the expansion is transferred from the fluid to the surrounding environment. This is in contrast to an "isentropic" expansion, in which a majority or substantially all of the work generated during the expansion is transferred to the surrounding environment.

As a result of the expansion, the temperature of the flashed or expanded fluid stream in conduit 128 can be at least 2, 5, or 10° C. and/or not more than 50, 40, or 30° C. lower than the temperature of the stream in conduit 124. Furthermore, the pressure of the flashed or expanded fluid stream in conduit 128 can be at least 0.1, 0.2, or 0.3 and/or not more than 1.5, 1, or 0.5 MPa lower than the pressure of the stream in conduit 124.

As shown in FIG. 1, the expanded two-phase stream in conduit 128 can be introduced into a first fluid inlet 38 of a distillation column 40. As used herein, the terms "first," "second," "third," and the like are used to describe various elements and such elements should not be limited by these terms. These terms are only used to distinguish one element from another and do not necessarily imply a specific order or even a specific element. For example, an element may be regarded as a "first" element in the description and a "second element" in the claims without departing from the scope of the present invention. Consistency is maintained within the description and each independent claim, but such nomenclature is not necessarily intended to be consistent therebetween.

The distillation column 40 can be any vapor-liquid separation vessel capable of further separating methane from hydrogen and carbon monoxide. In one or more embodiments, the distillation column 40 can be a multi-stage distillation column comprising at least 2, 5, 10, or 12 and/or not more than 50, 40, 30, or 20 actual or theoretical separation stages. When the distillation column 40 comprises a multi-stage column, one or more types of column internals may be utilized in order to facilitate heat and/or mass transfer between the vapor and liquid phases. Examples of suitable column internals can include, but are not limited to, vapor-liquid contacting trays, structured packing, random packing, and any combination thereof.

In various embodiments, the distillation column 40 can be operable to separate at least 65, 75, 85, 90, or 99 percent of the methane present in the fluid streams introduced thereto. The distillation column 40 can operate at a pressure of at least about 1, 1.5, 2, or 2.5 and/or not more than about 5, 4, 3.5, or 3 MPa. More particularly, the distillation column 40 can operate at a pressure in the range of 1 to 5, 1.5 to 4, 2 to 3.5, or 2.5 to 3 MPa. In certain embodiments, the distillation column 40 can operate at a pressure of about 2.6 MPa.

The temperature of the distillation column 40 can vary depending on the contents of the hydrocarbon-containing gas introduced into the system. In various embodiments, the top half of the distillation column 40 can operate at a temperature of at least −125, −150, −160, or −170° C. and/or not more than about −215, −200, −190, or −180° C. More particularly, the top half of the distillation column 40 can operate at a temperature in the range of −125 to −215° C., −150 to −200° C., −160 to −190° C., or −170 to −180° C. In certain embodiments, the top half of the distillation column 40 can operate at a temperature of about −173° C. Furthermore, the bottom half of the distillation column 40 can operate at a temperature of at least about −110, −125, −140, or −150° C. and/or not more than about −200, −190, −180, or −160° C. More particularly, the bottom half of the distillation column 40 can operate at a temperature in the range of −110 to −200° C., −125 to −190° C., −140 to −180° C., or −150 to −160° C. In certain embodiments, the bottom half of the distillation column 40 can operate at a temperature of about −158° C. Additional information regarding the operation of the distillation column 40 is discussed in further detail below.

Referring back to the initial methane-poor overhead stream in conduit 126, at least a portion of this stream can be transferred to an expansion device 42. As shown in FIG.

1, the stream from conduit 126 can be expanded via expansion device 42 to thereby provide a flashed or expanded vapor stream in conduit 130. In certain embodiments, the expansion can be substantially isenthalpic expansion, and expansion device 42 can be a Joule-Thompson valve or orifice. In other embodiments, the expansion may be substantially isentropic and expansion device 42 may be a turboexpander or expansion turbine. In various embodiments, the expansion can occur at a temperature in the range of −110 to −200° C., −130 to −190° C., −150 to −180° C., or −160 to −175° C.

As a result of the expansion, the temperature of the flashed or expanded fluid stream in conduit 130 can be at least 2, 5, or 10° C. and/or not more than 50, 40, or 30° C. lower than the temperature of the stream in conduit 126. Furthermore, the pressure of the flashed or expanded fluid stream in conduit 130 can be at least 0.1, 0.2, or 0.3 and/or not more than 1.5, 1, or 0.5 MPa lower than the pressure of the stream in conduit 126.

As shown in FIG. 1, at least a portion of the expanded stream in conduit 130 can be introduced into a second inlet 44 of the distillation column 40. In certain embodiments, the second inlet 44 can be positioned at a higher separation stage than the first inlet 38. As used herein, the terms "higher separation stage" and "lower separation stage" refer to actual, theoretical, or actual or theoretical heat and/or mass transfer stages vertically spaced within a distillation column. In one or more embodiments, the second fluid inlet 44 can be positioned in the upper one-half, upper one-third, or upper one-fourth of the total number of separation stages within distillation column 40, while first inlet 38 can be positioned in the lower one-half, the lower two-thirds, or the middle or lower one-third or one-fourth of the total number of separation stages within distillation column 40. According to various embodiments, the first and second fluid inlets 38, 44 can be vertically spaced from one another by at least 1, 4, 8, 10, or 12 actual, theoretical, or actual or theoretical heat and/or mass transfer stages of the distillation column 40.

As depicted in FIG. 1, a first methane-rich bottom stream exits the distillation column 40 via conduit 132 and a first methane-poor overhead stream exits the distillation column 40 via conduit 134.

The first methane-rich bottom stream in conduit 132 can be in the form of a liquid and comprise a significant amount of methane. For example, the first methane-rich bottom stream in conduit 132 can comprise at least about 10, 25, 40, or 50 and/or not more than about 95, 85, 75, or 70 mole percent of methane. More particularly, the first methane-rich bottom stream in conduit 132 can comprise in the range of 10 to 95, 25 to 85, 40 to 75, or 50 to 70 mole percent of methane.

Furthermore, the first methane-rich bottom stream in conduit 132 can also comprise some residual hydrogen and carbon monoxide. For example, the first methane-rich bottom stream in conduit 132 can comprise less than 15, 10, 5, or 2 mole percent of hydrogen. Additionally or alternatively, first methane-rich bottom stream in conduit 132 can comprise less than about 60, 50, 45, or 40 mole percent of carbon monoxide.

The first methane-poor overhead stream in conduit 134 can be in the form of a vapor and comprise significant amounts of hydrogen and carbon monoxide. For example, the first methane-poor overhead stream in conduit 134 can comprise at least about 25, 40, 60, or 75 and/or not more than about 99, 95, 90, or 85 mole percent of hydrogen. More particularly, the first methane-poor overhead stream in conduit 134 can comprise in the range of 25 to 99, 40 to 95, 60 to 90, or 75 to 85 mole percent of hydrogen. Additionally or alternatively, the first methane-poor overhead stream in conduit 134 can comprise at least about 1, 5, 10, or 20 and/or not more than about 75, 60, 50, or 40 mole percent of carbon monoxide. More particularly, the first methane-poor overhead stream in conduit 134 can comprise in the range of 1 to 75, 5 to 60, 10 to 50, or 20 to 40 mole percent of carbon monoxide.

Furthermore, the first methane-poor overhead stream in conduit 134 can also comprise some residual methane. For example, the first methane-poor overhead stream in conduit 134 can comprise less than about 10, 5, 1, or 0.5 mole percent of methane.

As shown in FIG. 1, the first methane-poor overhead stream in conduit 134 can be routed to a warming pass 46 of the primary heat exchanger 20, wherein the stream can be warmed via indirect heat exchange with passes 24 and 26, which are described below in further detail below. The resulting warmed vapor stream in conduit 136 can optionally be compressed via residue gas compressor 48 before being routed out of LNG recovery facility 10 via conduit 138. Once removed from LNG recovery facility 10, the compressed gas stream in conduit 138 can be routed to further use, processing, and/or storage.

Turning once again to the first methane-rich bottom stream in conduit 132, at least a portion of this stream can be introduced into the methane fractionator 30 via inlet 50. In various embodiments, the purpose of the methane fractionator is to further purify the stream in conduit 132.

The methane fractionator 30 can be any vapor-liquid separation vessel capable of further separating methane from hydrogen and carbon monoxide. In one or more embodiments, the methane fractionator 30 can be a multi-stage distillation column comprising at least 2, 5, 10, or 12 and/or not more than 50, 40, 30, or 20 actual or theoretical separation stages. When the methane fractionator 30 comprises a multi-stage column, one or more types of column internals may be utilized in order to facilitate heat and/or mass transfer between the vapor and liquid phases. Examples of suitable column internals can include, but are not limited to, vapor-liquid contacting trays, structured packing, random packing, and any combination thereof.

In various embodiments, the methane fractionator 30 can be operable to separate at least 65, 75, 85, 90, or 99 percent of the methane present in the fluid streams introduced thereto. The methane fractionator 30 can operate at a pressure of at least about 0.25, 0.5, 1, or 1.5 and/or not more than about 4, 3, 2, or 1.8 MPa. More particularly, the methane fractionator 30 can operate at a pressure in the range of 0.25 to 4, 0.5 to 3, 1 to 2, or 1.5 to 1.8 MPa. In certain embodiments, the methane fractionator 30 can operate at a pressure of about 1.7 MPa.

The temperature of the methane fractionator 30 can vary depending on the contents of the hydrocarbon-containing gas introduced into the system. In various embodiments, the top half of the methane fractionator 30 can operate at a temperature of at least −110, −125, −140, or −150° C. and/or not more than about −215, −200, −175, or −160° C. More particularly, the top half of the methane fractionator 30 can operate at a temperature in the range of −110 to −215° C., −125 to −200° C., −140 to −175° C., or −150 to −160° C. In certain embodiments, the top half of the methane fractionator 30 can operate at a temperature of about −154° C. Furthermore, the bottom half of the methane fractionator 30 can operate at a temperature of at least about −80, −90, −100, or −110° C. and/or not more than about −200, −160, −130, or −120° C. More particularly, the bottom half of the methane fractionator 30 can operate at a temperature in the range of −80 to −200° C., −90 to −160° C., −100 to −130° C., or −110 to −120° C. In certain embodiments, the bottom half of the methane fractionator 30 can operate at a temperature of about −112° C.

As depicted in FIG. 1, a second methane-rich bottom stream exits the methane fractionator 30 via conduit 140 and a second methane-poor overhead stream exits the methane fractionator 30 via conduit 142.

The second methane-rich bottom stream in conduit 140 can be in the form of a liquid and comprise significant amounts of methane. For example, the second methane-rich bottom stream in conduit 140 can comprise at least about 60, 75, 90, or 99 mole percent of methane. Furthermore, the second methane-rich bottom stream in conduit 140 can also contain residual amounts of hydrogen and/or carbon monoxide. For instance, the second methane-rich bottom stream in conduit 140 can comprise less than 1, 0.5, 0.1, or 0.01 mole percent of hydrogen. Additionally or alternatively, the second methane-rich bottom stream in conduit 140 can comprise less than 1, 0.5, 0.1, or 0.01 mole percent of carbon monoxide.

The second methane-poor overhead stream in conduit 142 can be in the form of a vapor and comprises predominantly hydrogen and/or carbon monoxide. For example, the second methane-poor overhead stream in conduit 142 can comprise at least about 1, 2, 4, or 10 and/or not more than about 40, 30, 20, or 15 mole percent of hydrogen. More particularly, the second methane-poor overhead stream in conduit 142 can comprise in the range of 1 to 40, 2 to 30, 4 to 20, or 10 to 15 mole percent of hydrogen. Additionally or alternatively, the second methane-poor overhead stream in conduit 142 can comprise at least about 50, 65, 80, or 90 mole percent of carbon monoxide. Moreover, the second methane-poor overhead stream in conduit 142 can comprise some residual methane. For instance, the second methane-poor overhead stream in conduit 142 can comprise less than 1, 0.5, 0.1, or 0.01 mole percent of methane.

As shown in FIG. 1, the second methane-rich bottom stream in conduit 140 can be routed to a cooling pass 52 disposed within the primary heat exchanger 20, wherein the liquid stream can be cooled and at least partially condensed via indirect heat exchange with the refrigerant and/or residue gas streams in respective passes 24 and 26, which are described below in further detail. The cooled stream exiting cooling pass 52 via conduit 144 can be an LNG-enriched product. As used herein, "LNG-enriched" means that the particular composition comprises at least 50 mole percent of methane. It should be noted that this LNG-enriched product generally has the same composition as the second methane-rich bottom stream described above. The LNG-enriched product in conduit 144 can have a temperature of at least −120, −130, −140, or −145° C. and/or not more than about −200, −190, −180, or −165° C. More particularly, the LNG-enriched product in conduit 144 can have a temperature in the range of about −120 to −200° C., −130 to −190° C., −140 to −180° C., or −145 to −165° C. In certain embodiments, the LNG-enriched product in conduit 144 can have a temperature of about −156° C.

Turning back to the second methane-poor overhead stream in conduit 142, this stream can be routed to a cooling pass 54 disposed within the primary heat exchanger 20, wherein the stream can be cooled and at least partially condensed via indirect heat exchange with the refrigerant and/or residue gas streams in respective passes 24 and 26, which are described below in further detail. The cooled gas stream exiting cooling pass 54 via conduit 146 can have a temperature of at least −120, −130, −140, or −145° C. and/or not more than about −200, −190, −180, or −165° C. More particularly, the cooled stream in conduit 146 can have a temperature in the range of about −120 to −200° C., −130 to −190° C., −140 to −180° C., or −145 to −165° C. In certain embodiments, the cooled stream in conduit 146 can have a temperature of about −156° C.

The cooled stream in conduit 146 can then be routed to a reflux condenser drum 56, wherein at least a portion of the cooled stream in conduit 146 can be divided into a methane-rich liquid reflux stream and an overhead methane-poor stream. The methane-rich liquid reflux stream exits the reflux condenser drum 56 via conduit 148 and the overhead methane-poor stream exits the reflux condenser drum 56 via conduit 150. The methane-rich liquid reflux in conduit 148 can have the same or similar composition to the second methane-rich bottom stream described above and the overhead methane-poor stream in conduit 150 can have the same or similar composition to the second methane-poor overhead stream described above.

The methane-rich liquid reflux in conduit 148 can be pumped via reflux pump 58 to conduit 152 where it can be transferred to expansion device 62 and/or expansion device 64, where the pressure of the liquid can be reduced to thereby flash or vaporize at least a portion thereof. Expansion devices 62, 64 can be any suitable expansion device, such as, for example, a Joule-Thompson valve or orifice or a hydraulic turbine. It should be noted that expansion devices 62, 64 can function and operate in the same or similar manner as expansion device 36 described above. In certain embodiments, at least a portion of the methane-rich liquid reflux in conduit 152 can be introduced into expansion device 62 and transferred via conduit 154 to be used as a reflux stream in the distillation column 40. Additionally or alternatively, at least a portion of the methane-rich liquid reflux in conduit 152 can be introduced into expansion device 64 and transferred via conduit 156 to be used as a reflux stream in the methane fractionator 30.

Turning again to FIG. 1, the overhead methane-poor stream in conduit 150 can be routed to a compressor 66, which is connected to the expansion device 42 via shaft 68. The compressed stream exiting the compressor 66 via conduit 158 can be introduced into conduit 134 to function as cold media in cooling pass 46 as described above.

Turning now to refrigeration cycle 12 of LNG recovery facility 10 depicted in FIG. 1, this refrigeration cycle is further described in U.S. Pat. No. 5,657,643, which is incorporated by reference in its entirety. The closed-loop refrigeration cycle 12 is illustrated as generally comprising a refrigerant compressor 70, an optional interstage cooler 72 and interstage accumulator 74, a refrigerant condenser 76, a refrigerant accumulator 78, and a refrigerant suction drum 80. As shown in FIG. 1, a mixed refrigerant stream withdrawn from suction drum 80 via conduit 160 can be routed to a suction inlet of refrigerant compressor 70, wherein the pressure of the refrigerant stream can be increased. When refrigerant compressor 70 comprises a multistage compressor having two or more compression stages, as shown in FIG. 1, a partially compressed refrigerant stream exiting the first (low pressure) stage of compressor 70 can be routed via conduit 162 to interstage cooler 72, wherein the stream can be cooled and at least partially condensed via indirect heat exchange with a cooling medium (e.g., cooling water or air).

The resulting two-phase stream in conduit 164 can be introduced into interstage accumulator 74, wherein the vapor and liquid portions can be separated. A vapor stream withdrawn from accumulator 74 via conduit 166 can be routed to the inlet of the second (high pressure) stage of refrigerant compressor 70, wherein the stream can be further compressed. The resulting compressed refrigerant vapor stream can be recombined with a portion of the liquid phase refrigerant withdrawn from interstage accumulator 74 via conduit 168 and pumped to pressure via refrigerant pump 82, as shown in FIG. 1.

The combined refrigerant stream in conduit 170 can then be routed to refrigerant condenser 76, wherein the pressurized refrigerant stream can be cooled and at least partially condensed via indirect heat exchange with a cooling medium (e.g., cooling water) before being introduced into refrigerant accumulator 78 via conduit 172. As shown in FIG. 1, the vapor and liquid portions of the two-phase refrigerant stream in conduit 172 can be separated and separately withdrawn from refrigerant accumulator 78 via respective conduits 174 and 176. Optionally, a portion of the liquid stream in conduit 176, pressurized via refrigerant pump 84, can be combined with the vapor stream in conduit 174 just prior to or within a refrigerant cooling pass 24 disposed within primary exchanger 20, as shown in FIG. 1. In one embodiment, re-combining a portion of the vapor and liquid portions of the compressed refrigerant in this manner may help ensure proper fluid distribution within refrigerant cooling pass 24.

As the compressed refrigerant stream flows through refrigerant cooling pass 24, the stream is condensed and sub-cooled, such that the temperature of the liquid refrigerant stream withdrawn from primary heat exchanger 20 via conduit 178 is well below the bubble point of the refrigerant mixture. The sub-cooled refrigerant stream in conduit 178 can then be expanded via passage through an expansion device 86 (illustrated herein as Joule-Thompson valve 86), wherein the pressure of the stream can be reduced, thereby cooling and at least partially vaporizing the refrigerant stream. The cooled, two-phase refrigerant stream in conduit 180 can then be routed through a refrigerant warming pass 26, wherein a substantial portion of the refrigeration generated via the expansion of the refrigerant can be recovered as cooling for one or more process streams, including the feed stream flowing through cooling pass 24, as discussed in detail previously. The warmed refrigerant stream withdrawn from primary heat exchanger 20 via conduit 182 can then be routed to refrigerant suction drum 80 before being compressed and recycled through closed-loop refrigeration cycle 12 as previously discussed.

According to various embodiments, during each step of the above-discussed refrigeration cycle, the temperature of the refrigerant can be maintained such that at least a portion, or a substantial portion, of the methane originally present in the feed gas stream can be condensed in primary exchanger 20. For example, in various embodiments, at least 50, 65, 75, 80, 85, 90, or 95 percent of the total methane originally present in the feed gas stream introduced into primary exchanger 20 can be condensed. In some embodiments, operating refrigeration cycle 12 at warmer temperatures may decrease the formation of one or more undesirable byproducts within the feed gas stream, such as, for example nitrogen oxide gums (e.g., $NO_x$ gums) which can form at temperatures below about −100° C. According to embodiments of the present invention, formation of such byproducts can be minimized or nearly eliminated.

In one embodiment, the refrigerant utilized in the closed-loop refrigeration cycle 12 can be a mixed refrigerant. As used herein, the term "mixed refrigerant" refers to a refrigerant composition comprising two or more constituents. In one embodiment, the mixed refrigerant utilized by refrigeration cycle 12 can comprise two or more constituents selected from the group consisting of methane, ethylene, ethane, propylene, propane, isobutane, n-butane, isopentane, n-pentane, and combinations thereof. In some embodiments, the refrigerant composition can comprise methane, ethane, propane, normal butane, and isopentane and can substantially exclude certain components, including, for example, nitrogen or halogenated hydrocarbons. According to one or more embodiments, the refrigerant composition can have an initial boiling point of at least −80, −85, or −90° C. and/or not more than −50, −55, or −60° C. Various specific refrigerant compositions are contemplated according to embodiments of the present invention. Table 1, below, summarizes broad, intermediate, and narrow ranges for several exemplary refrigerant mixtures.

TABLE 1

Exemplary Mixed Refrigerant Compositions

| Component | Broad Range, mole % | Intermediate Range, mole % | Narrow Range, mole % |
|---|---|---|---|
| methane | 0 to 50 | 5 to 40 | 10 to 30 |
| ethylene | 0 to 50 | 5 to 40 | 10 to 30 |
| ethane | 0 to 50 | 5 to 40 | 10 to 30 |
| propylene | 0 to 50 | 5 to 40 | 5 to 30 |
| propane | 0 to 50 | 5 to 40 | 5 to 30 |
| i-butane | 0 to 10 | 0 to 5 | 0 to 2 |
| n-butane | 0 to 25 | 1 to 20 | 5 to 15 |
| i-pentane | 0 to 30 | 1 to 20 | 2 to 15 |
| n-pentane | 0 to 10 | 0 to 5 | 0 to 2 |

In some embodiments of the present invention, it may be desirable to adjust the composition of the mixed refrigerant to thereby alter its cooling curve and, therefore, its refrigeration potential. Such a modification may be utilized to accommodate, for example, changes in composition and/or flow rate of the feed gas stream introduced into LNG recovery facility 10. In one embodiment, the composition of the mixed refrigerant can be adjusted such that the heating curve of the vaporizing refrigerant more closely matches the cooling curve of the feed gas stream. One method for such curve matching is described in detail in U.S. Pat. No. 4,033,735, the disclosure of which is incorporated herein by reference in its entirety.

Thus, the above described processes and systems can be utilized to recover a LNG stream from a hydrocarbon-containing feed gas stream. Furthermore, due to configurations described above, the processes and systems described herein due not need to utilize a nitrogen refrigerant stream that is separate from the mixed refrigerant system described above.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

As used herein, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. Thus, the present invention can include a variety of combinations and/or integrations of the embodiments described herein.

As used herein, the term "about" means that the associated value can vary by 10 percent from its recited value.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

What is claimed is:

1. A process for recovering liquid methane gas from a hydrocarbon-containing gas, the process comprising:

(a) cooling and at least partially condensing the hydrocarbon-containing gas to thereby provide a cooled feed stream, wherein at least a portion of the cooling in step (a) is carried out via indirect heat exchange with a mixed refrigerant stream in a closed-loop refrigeration cycle;

(b) separating at least a portion of the cooled feed stream in a primary distillation column to thereby form a first methane-rich bottom stream and a first methane-poor overhead stream comprising at least 1 mole % of carbon monoxide;

(c) fractionating at least a portion of the first methane-rich bottom stream in a secondary distillation column to thereby form a second methane-rich bottom stream and a second methane-poor overhead stream;

(d) cooling and at least partially condensing the second methane-poor overhead stream to thereby form a cooled overhead stream;

(e) separating the cooled overhead stream in a condenser drum to thereby form a third methane-poor overhead stream and a methane-rich liquid reflux stream;

(f) flashing a first portion of the liquid reflux stream and introducing the first portion into the primary distillation column as reflux;

(g) flashing a second portion of the liquid reflux stream and introducing the second portion into the secondary distillation column as reflux; and (h) cooling the second methane-rich bottom stream to thereby produce an LNG-enriched stream and recovering the LNG-enriched stream without further separating, wherein the process does not contain a nitrogen refrigeration loop.

2. The process of claim 1, further comprising precooling the hydrocarbon-containing gas prior to the cooling of step (a) to thereby form a precooled hydrocarbon-containing gas, wherein the precooled hydrocarbon-containing gas is the hydrocarbon-containing gas in step (a).

3. The process of claim 2, wherein at least a portion of the precooling is carried out via indirect heat exchange with the mixed refrigerant stream in the closed-loop refrigeration cycle.

4. The process of claim 1, further comprising, prior to the separating of step (b), splitting the cooled feed stream in a vapor-liquid separator to thereby form an initial methane-rich liquid stream and an initial methane-poor vapor stream, wherein the cooled feed stream in the separating of step (b) comprises the initial methane-rich liquid stream, the initial methane-poor vapor stream, or a combination thereof.

5. The process of claim 1, wherein the hydrocarbon-containing gas is a synthesis gas comprising methane, hydrogen, and carbon monoxide.

6. The process of claim 1, wherein the separating of step (b) occurs at a pressure in the range of 1.5 to 5 MPa.

7. The process of claim 6, wherein the fractionating of step (c) occurs at a pressure in the range of 0.5 to 3 MPa.

8. The process of claim 1, wherein the cooled feed stream has a temperature in the range of −120 to −200° C.

9. A process for recovering liquid methane gas from a hydrocarbon-containing gas, the process comprising:

(a) cooling and at least partially condensing the hydrocarbon-containing gas to thereby provide a cooled feed stream;

(b) splitting the cooled feed stream in a vapor-liquid separator to thereby form an initial methane-rich liquid stream and an initial methane-poor vapor stream;

(c) expanding the initial methane-rich liquid stream to form a two-phase stream;

(d) introducing the two-phase stream directly into a primary distillation column and separating the two-phase stream in the primary distillation column to thereby form a first methane-rich liquid stream and a first methane-poor vapor stream, wherein the separating occurs at a pressure in the range of 1.5 to 5 MPa;

(e) fractionating the first methane-rich liquid stream in a secondary distillation column to thereby form a second methane-rich liquid stream and a second methane-poor vapor stream, wherein the fractionating occurs at a pressure in the range of 0.5 to 3 MPa;

(f) cooling and at least partially condensing the second methane-poor overhead stream to thereby form a cooled overhead stream;

(g) separating the cooled overhead stream in a condenser drum to thereby form a third methane-poor overhead stream and a methane-rich liquid reflux stream;

(h) flashing a first portion of the liquid reflux stream and introducing the first portion into the primary distillation column as reflux;

(i) flashing a second portion of the liquid reflux stream and introducing the second portion into the secondary distillation column as reflux; and (j) cooling at least a portion of the second methane-rich liquid stream to thereby form an LNG-enriched liquid stream.

10. The process of claim 9, wherein at least a portion of the cooling in step (a) and the cooling in step (f) are carried out via indirect heat exchange with a single mixed refrigerant stream in a closed-loop refrigeration cycle, a dual mixed refrigerant cycle, or a cascade refrigeration cycle.

11. The process of claim 9, wherein at least a portion of the cooling in step (a) and the cooling in step (f) are carried out via indirect heat exchange with a mixed refrigerant stream in a closed-loop refrigeration cycle.

12. The process of claim 9, further comprising precooling the hydrocarbon-containing gas prior to the cooling of step (a) to thereby form a precooled hydrocarbon-containing gas, wherein at least a portion of the precooling is carried out via indirect heat exchange with a mixed refrigerant stream in a closed-loop refrigeration cycle, wherein the precooled hydrocarbon-containing gas is the hydrocarbon-containing gas in step (a).

13. The process of claim 9, wherein the hydrocarbon-containing gas is a synthesis gas comprising methane, hydrogen, and carbon monoxide.

14. The process of claim 9, wherein the cooled feed stream has a temperature in the range of −120 to −200° C.

15. The process of claim 9, wherein the process does not contain a nitrogen refrigeration loop.

16. The process of claim 9, further comprising:

(i) expanding the initial methane-poor vapor stream to thereby form an expanded initial methane-poor vapor stream; and (ii) introducing the expanded initial methane-poor vapor stream into the primary distillation column.

17. The process of claim 1, wherein the first methane-poor overhead stream comprises less than 0.5 mole % of methane.

18. The process of claim 1, wherein the second methane-poor overhead stream comprises at least 50 mole % of carbon monoxide.

19. The process of claim 1, wherein the second methane-rich bottom stream comprises less than 1 mole % of carbon monoxide.

20. The process of claim 1, wherein the cooling of steps (a), (d), and (h) all occur within a primary heat exchanger.

21. The process of claim 9, wherein the cooling of steps (a), (f), and (j) all occur within a primary heat exchanger.

22. The process of claim 1, wherein the first methane-rich bottom stream is in the form of a liquid when introduced into the secondary distillation column for the fractionating of step (c).

* * * * *